United States Patent [19]

Lowder

[11] 4,171,208

[45] Oct. 16, 1979

[54] VACUUM CLEANER INCLUDING DIVERTER VALVE

[75] Inventor: Dale E. Lowder, North Muskegon, Mich.

[73] Assignee: Clarke-Gravely Corporation, Muskegon, Mich.

[21] Appl. No.: 838,564

[22] Filed: Oct. 3, 1977

[51] Int. Cl.[2] ..... B01D 46/00

[52] U.S. Cl. ..... 55/216; 55/372; 55/380; 55/417; 55/472; 15/327 D; 15/353; 137/205; 137/206; 137/625.44

[58] Field of Search ..... 55/216, 417, 418, 467, 55/470–472, 372, 380; 15/327 D, 353; 137/205, 206, 625.44; 417/423 A, 315

[56] References Cited

U.S. PATENT DOCUMENTS

| | | | |
|---|---|---|---|
| 2,526,212 | 10/1950 | Erling | 417/315 |
| 2,643,732 | 6/1953 | Keen | 55/216 |
| 3,331,090 | 7/1967 | Reiber et al. | 15/321 |
| 3,516,440 | 6/1970 | Whitlock | 137/625.44 |
| 3,605,786 | 9/1971 | Machin, Jr. | 15/330 |
| 3,909,219 | 9/1975 | Fromknecht | 55/216 |

FOREIGN PATENT DOCUMENTS

| | | | |
|---|---|---|---|
| 265965 | 8/1927 | United Kingdom | 55/471 |

*Primary Examiner*—Bernard Nozick

*Attorney, Agent, or Firm*—Price, Heneveld, Huizenga & Cooper

[57] ABSTRACT

A wet/dry vacuum apparatus is disclosed including a collection tank and a suction head. The suction head includes a base defining a tank inlet aperture, a blower intake aperture, a blower exhaust aperture, an atmospheric, intake-discharge aperture and an integrally molded valve housing. A blower is secured to the base in line with the intake aperture and includes an exhaust outlet connected to the exhaust aperture. The valve housing is opposite the blower and defines a tank opening communicating with the collection tank. A planar valve element is rotatably mounted within the housing and selectively permits communication of the blower intake with the tank for collection of debris and liquid or connection of the blower exhaust outlet with the tank to pressurize the tank and force the contents thereof out through the tank inlet.

20 Claims, 9 Drawing Figures

VACUUM CLEANER INCLUDING DIVERTER VALVE

BACKGROUND OF THE INVENTION

The present invention relates to vacuum cleaning apparatus and more particularly to wet/dry vacuum devices including a suction head supported on an open top collection tank.

Heretofore, various forms of wet/dry vacuum cleaning devices have been proposed. These devices basically include an open top collection tank and a suction head having a blower and being supported on the top of the tank. The blower creates a vacuum in the tank and draws debris and liquid into the tank through a hose connected to an inlet carried by the suction head or the collection tank. Float valve devices have been included in such apparatus to prevent ingestion of the liquid into the blower.

In order to empty the liquid contents from the collection tank, with some of these prior proposals, it has been necessary to remove the suction head and physically lift and tilt the tank. This procedure is tiring, time-consuming and the tank may be dropped spilling the contents on the floor. As a result, several proposals have been made to use the blower to pressurize the tank and thereby force the liquid contained therein out the tank inlet. An example of one such prior device may be found in U.S. Pat. No. 2,643,732 to Keen, entitled VACUUM CLEANING MACHINE, and issued on June 30, 1953. The device disclosed in this patent includes a cover disposed on a collection tank and supporting a motor-fan unit. The motor-fan unit includes a pressure discharge nozzle on one end and an intake nozzle on the other end. A hose communicates at one end through the cover with the tank and is connected at its other end either to the pressure discharge of the motor-fan unit or the intake nozzle thereof. When connected to the intake nozzle, a vacuum is created in the tank and liquid and other debris may be drawn therein. When connected to the pressure discharge unit of the motor-fan unit, the tank is pressurized and the liquid is forced up through a pipe and discharged through a tank inlet fitting.

Examples of prior wet/dry vacuum devices which permit selective evacuation or pressurization of a collection tank but which do not require shifting of a hose connection may be found in U.S. Pat. No. 3,331,090 to Reiber et al, entitled LIQUID SUCTION, STORAGE AND DISCHARGE DEVICE, issued July 18, 1967 and U.S. Pat. No. 3,605,786 to Machin, Jr. entitled EVACUATOR, issued on Sept. 20, 1971. Each of the devices disclosed in these patents includes a form of diverter or reversing valve for selectively pressurizing or evacuating the receptacle or collection tank. The device disclosed in Reiber et al includes a rotary, two-position, circular reversing valve having kidney-shaped passages selectively interconnecting the intake and discharge of an air blower with the collection tank. The device disclosed in Machin includes a fairly complexly configured ring-like valve operable to selectively evacuate or pressurize the collection tank.

All of these devices are complex and costly. A need exists for a structurally simple wet/dry vacuum cleaner including a reversing or diverter valve whereby problems heretofore experienced relating to complexity and difficulty of manufacture are substantially eliminated.

SUMMARY OF THE INVENTION

In the present invention, economy and simplicity are achieved with Applicant's unique invention which includes a suction head having a one-piece, molded base with an integrally molded diverter valve housing adapted to rest on the collection tank. The base defines a tank inlet, an intake port or aperture, an exhaust aperture and an atmospheric intake-discharge aperture or port. A vacuum means is mounted on one side of the base and creates a vacuum or suction at the intake aperture of the base and further includes an exhaust outlet communicating with the base exchaust aperture. The valve housing molded integral with the base defines an opening communicating directly with the collection tank. A planar, valve element is positioned generally vertically within the valve housing and is rotatable between first and second positions about a vertical axis. The valve element when in the first position places the intake aperture in communication with the valve housing tank opening and the exhaust aperture in communication with the atmospheric intake-discharge aperture to create a suction within the tank. When in the second position, the valve element places the intake aperture in communication with the atmospheric intake-discharge aperture and the exhaust aperture of the blower in communication with the tank opening so that the tank is pressurized to thereby discharge liquid collected therein through the tank inlet.

DETAILED DESCRIPTION OF THE PREFERRED EMBODIMENT

Figure 1:
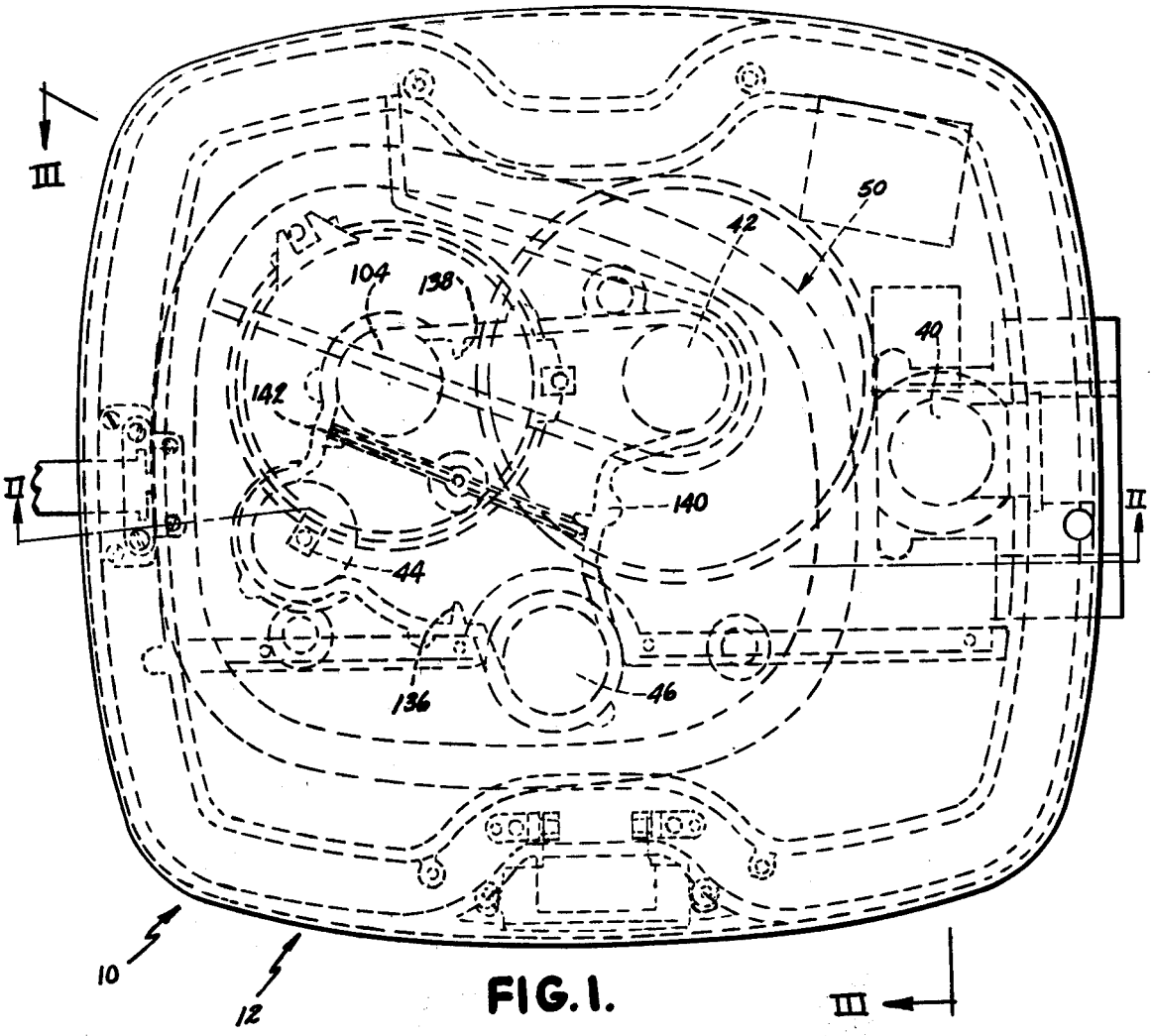
FIG. 1 is a top, plan view of the unique wet/dry vacuum cleaning apparatus in accordance with the present invention.
Figure 3:
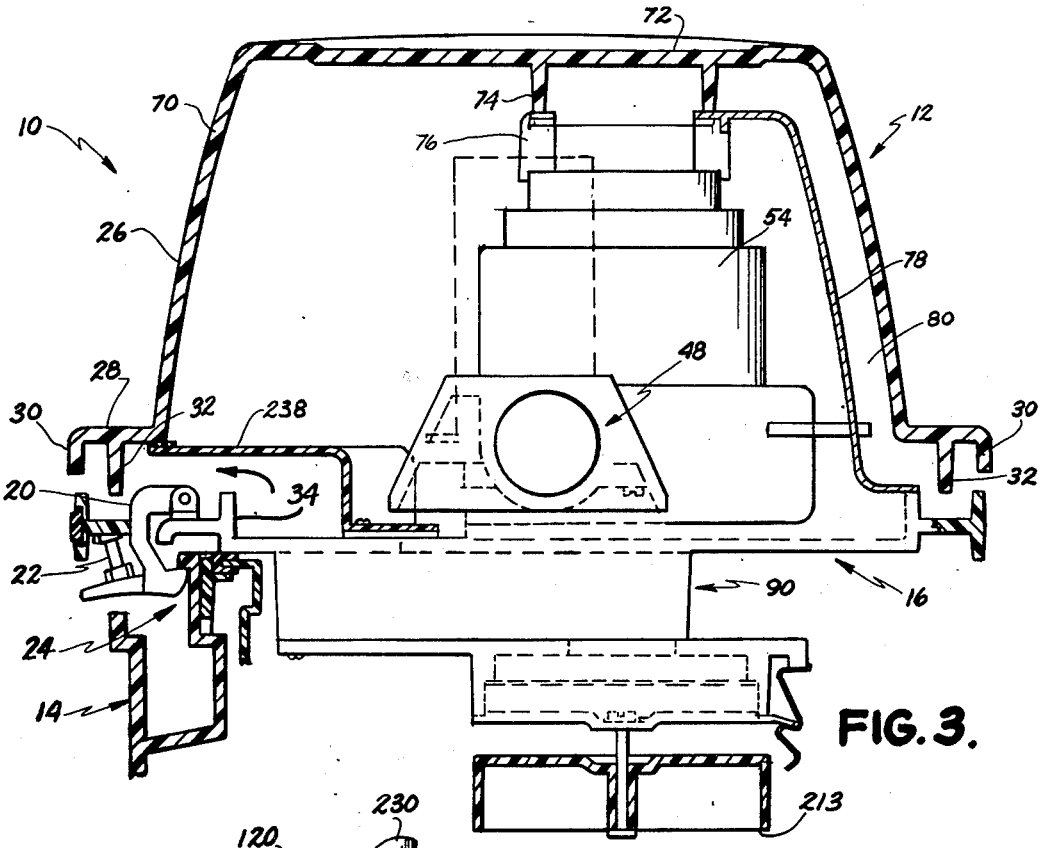
FIG. 3 is a fragmentary, cross-sectional view taken generally along line III—III of FIG. 1.
Figure 2:
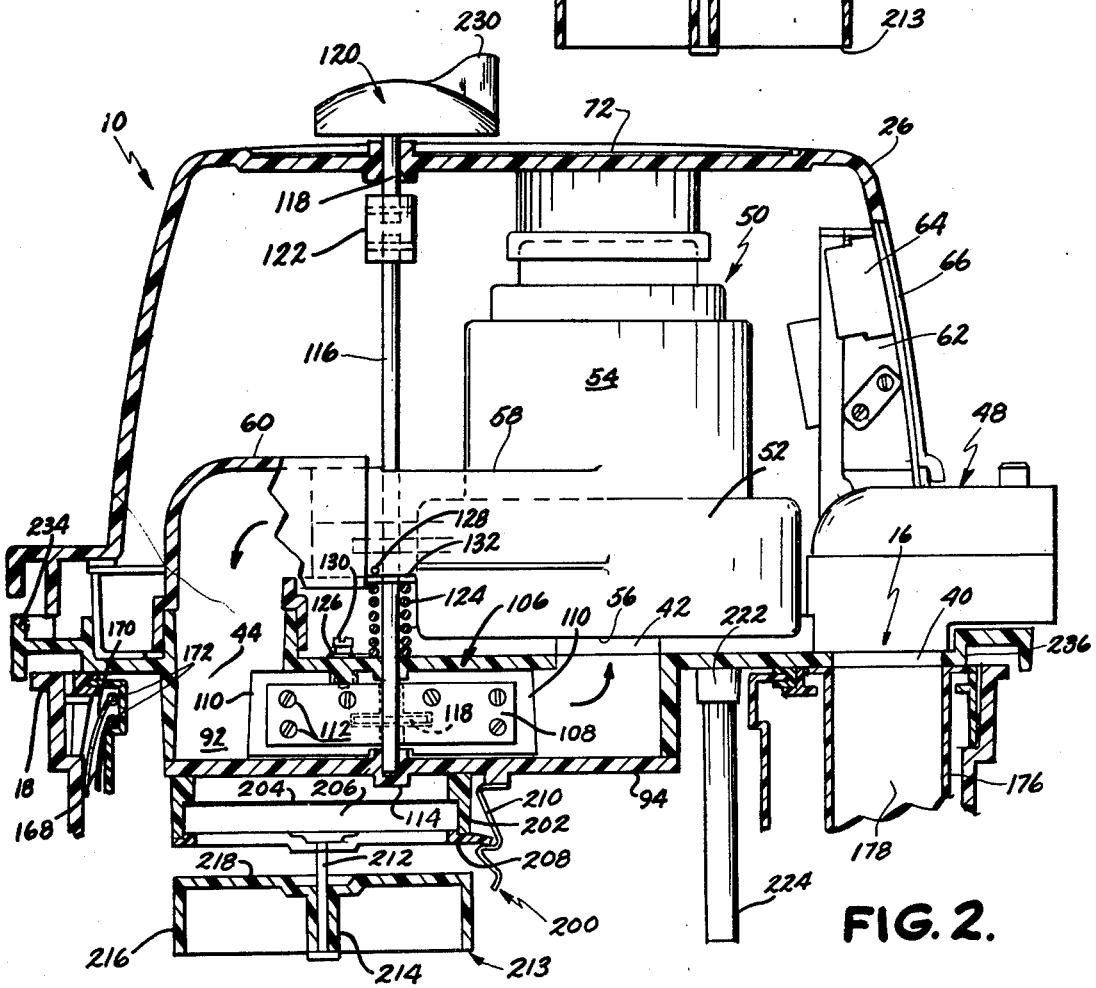
FIG. 2 is a fragmentary, cross-sectional, side elevational view taken generally along line II—II of FIG. 1.

The preferred embodiment of the unique wet/dry vacuum cleaner in accordance with the present invention is illustrated in FIGS. 1–3 and generally designated 10. The cleaning apparatus includes a suction head 12 supported upon an open top collection tank 14. The suction head 12 includes a molded, integral, one-piece base 16 adapted to rest on the upper, flanged, open end 18 of the tank 14. A plurality of handle clamps 20 (FIG. 3) each biased by a clamp spring 22 sealingly clamp the base 16 to the tank 14 at molded recesses 24. The suction head 12 also includes a molded plastic cover 26. The cover 26 includes a lower peripheral, horizontal flange 28, an outer, depending skirt 30 and an inner depending skirt 32. The skirts 30, 32 define intake and/or exhaust baffles as will be more fully described below and the cover rests on a peripheral, upstanding wall 34 molded integral with the base 16.

Figure 6:
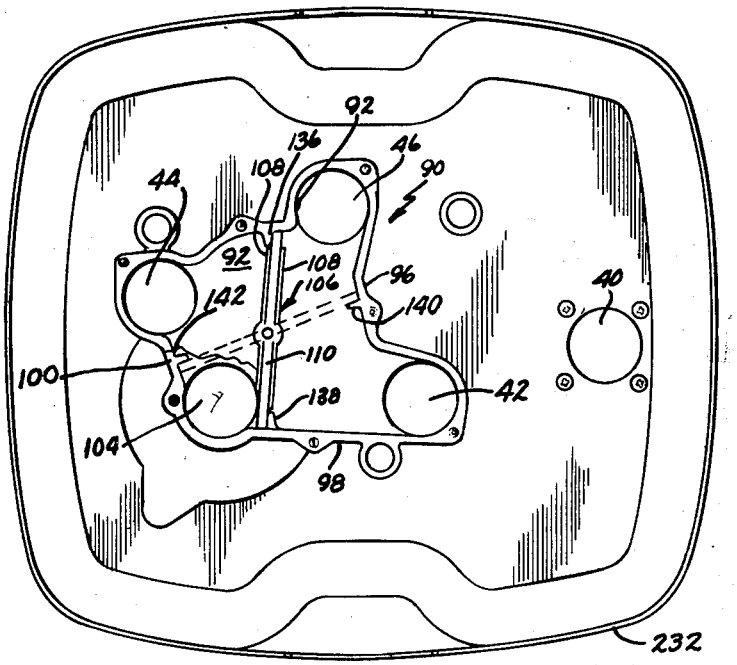
FIG. 6 is a bottom, plan view of the suction head showing the reversing or diverter valve.

As best seen in FIGS. 1 and 6, the base 16 defines therein a tank inlet aperture 40, a suction or blower intake aperture 42, a blower exhaust aperture 44 and an atmospheric intake-discharge aperture 46. As seen in FIG. 2, a hose adapter coupling 48 is secured to base 16 immediately above and in-line with the tank inlet aperture 40. The coupler 48 extends through the housing 26 and is adapted to receive an elongated, cleaner hose (not shown) in a conventional fashion. Bolted or otherwise suitably secured to the base 16 is an electric, motor-fan unit or blower 50. The unit 50 includes a fan mounted in housing 52 and driven by the output shaft of an electric motor 54. The blower includes an intake 56 disposed directly above and in line with the aperture 42 formed in the base 16. Further, the unit 50 includes an exhaust or blower outlet 58 which is connected to and placed in communication with the aperture 44 formed in the base 16 through a plastic or rubber tubing connector 60. This is best seen in FIGS. 2 and 4.

Figure 4:
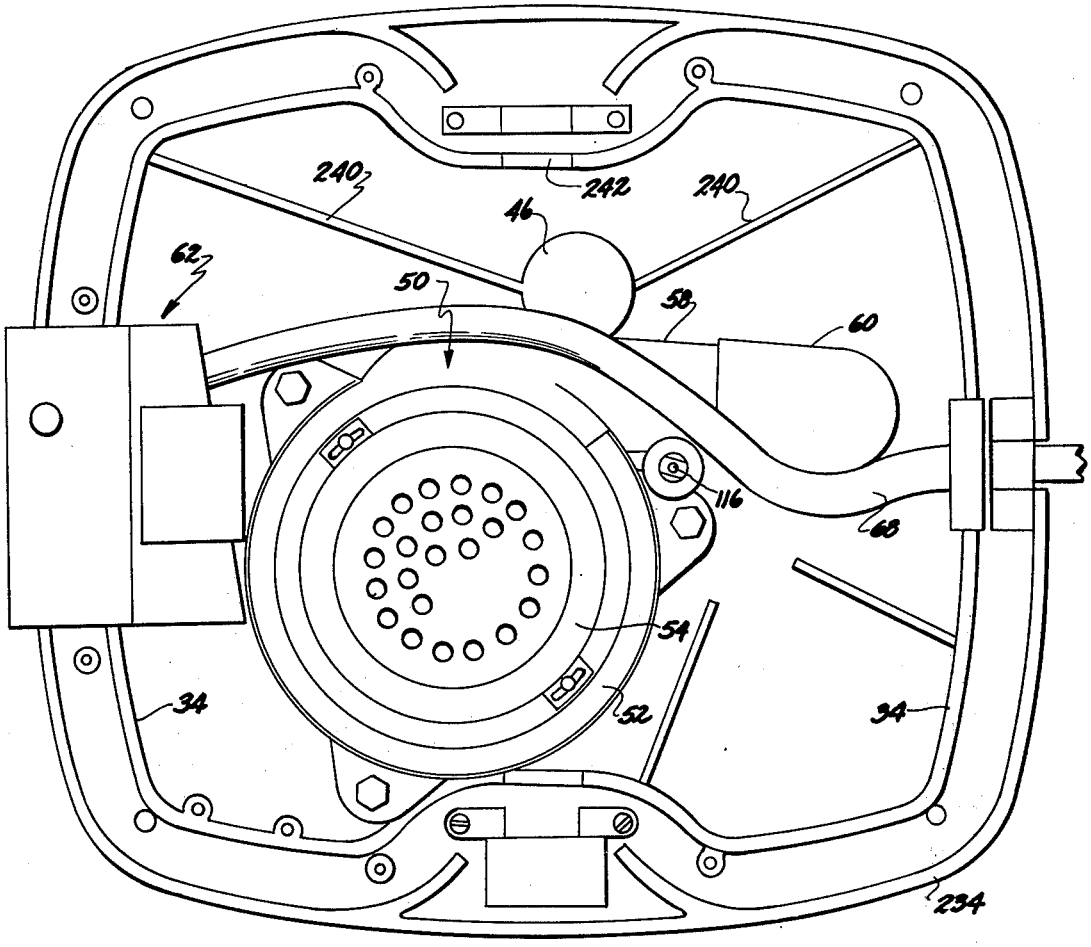
FIG. 4 is a top, plan view of the suction head of the wet/dry vacuum cleaning apparatus with the cover thereof removed.

As seen in FIGS. 2 and 4, a wiring panel or control box 62 is supported on the base adjacent the hose coupling 48. The panel 62 includes an on/off switch 64. The cover 26 is formed with an aperture 66 dimensioned to fit around the panel. Electrical power is supplied to the electric motor 54 through the panel or box 62 via a power cord 68.

As seen in FIG. 3, the cover includes a peripheral sidewall 70 and a top 72. Extending downwardly from the top 72 is an annular structure or skirt 74. Positioned between the top of the motor 54 and the bottom of the annular structure or skirt 74 is a foam, cylindrically shaped gasket 76. A plastic piece 78 is secured to the peripheral wall 70 of the housing and defines therewith a cooling air intake duct or passage 80. Cooling air is conveyed to the motor 54 by passing between the baffles 30, 32 of the housing through the conduit 80 and to the skirt 74 at the top of the motor 54.

As seen in FIGS. 2, 3, 5 and 6, the base 16 is fabricated with an integral valve housing generally designated 90. The valve housing defines a valve chamber 92 which is closed at the bottom by a separate plastic plate 94. The plate 94 may be fabricated or molded with ribs 96 to increase the rigidity thereof. With reference to FIG. 6, the valve housing 90 includes sidewalls 96, 98, 100 and 102. The circular apertures 42, 44, 46 formed in the base communicate with the chamber 92 and the plate 94 defines a circular aperture 104 which communicates with the tank. Therefore, the valve housing 90 including an integral walls 96, 98, 100, 102, the enclosure plate 94 and the base 16 defines a four-ported valve housing.

Pivotally mounted within the valve housing and chamber 92 is a vertically positioned, planar diverter or reversing valve 106. As seen in FIGS. 1, 2 and 6, the valve 106 includes a pair of metal retainers 108 of generally rectangular shape. The retainers sandwich therebetween a planar valve member 110. In the preferred construction, the valve member 110 is a two-part member formed in two halves from a resilient, sealing material such as gum rubber having a Durometer of 35–45. The retainers 108 are secured together and clamp the halves of the valve member 110 by screws or other suitable fasteners 112. Extending vertically from a lower bearing socket 114 defined by the plate 94 through the base 106 is a diverter actuator rod 116. The actuator rod is secured to the valve element 106 by a pin 118 (FIG. 2) which extends through a cross bore formed adjacent the lower end of the rod 116. Another rod 118 extends through the top 72 of the cover 26. A manually turnable knob 120 is secured to the upper end of rod 118. Rod 118 is secured to the actuator rod 116 by a coupling 122.

As best seen in FIG. 2, a coil spring 124 is positioned concentrically around the rod 116. One end 126 of the coil spring engages a fixed stop or bolt 130. The opposite end 128 of the coil spring engages a pin or dowel 130 which extends through a bore formed in the rod 116. The coil spring 124 biases the valve element 106 to one of two positions.

As best seen in FIG. 6, the valve housing 90 defines a plurality of inwardly directed, vertically extending stops 136, 138 and 140, 142. The stops 136, 138 abut opposite sides of the valve element 106 when the valve element is in one position and the stops 140, 142 similarly abut opposite sides of the valve element 106 when the valve element is an another position. The resilient, sealing members 110 of the valve element engage the stops providing a seal to prevent cross communication between the chambers defined by the valve housing and the valve element and therefore prevent cross communication between apertures 42, 44, 46 and 104.

As should now be readily apparent, when the valve element 106 is in the position shown in FIG. 1, the intake of the blower motor unit 50 will be placed in communication with the interior of the collection tank 14 through the apertures 42 and 104. The exhaust outlet of the blower motor unit 50 will be placed in communication with atmosphere through the base aperture 44 and the aperture 46. As a result, a vacuum or suction will be created within the collection tank and debris and liquid may be drawn into the tank through the hose (not shown), coupling 48 and the aperture 40.

When the valve element 106 is shifted to the position shown in solid lines in FIG. 6 wherein it abuts stops 136, 138, the blower motor unit will pressurize the collection tank 14. When in this position, the blower motor intake will be placed in communication with atmosphere through apertures 42, 46 and the valve housing. The blower motor outlet or exhaust will be placed in communication with the tank through aperture 44 in the base and aperture 104 in the housing plate 94. As a result, the tank will pressurize and the liquid and other debris collected therein may be discharged through the aperture or tank inlet 40, the coupling 48 and the hose connected thereto.

Figure 8:
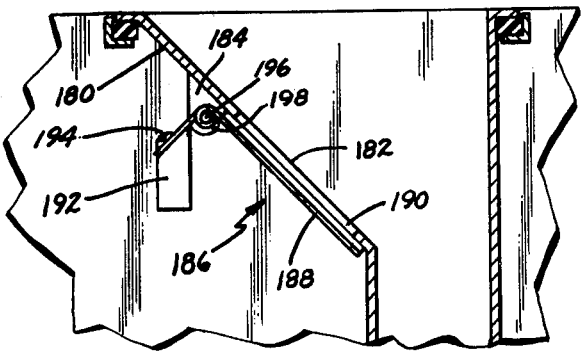
FIG. 8 is a fragmentary, cross-sectional view taken generally along line VIII—VIII of FIG. 7.
Figure 7:
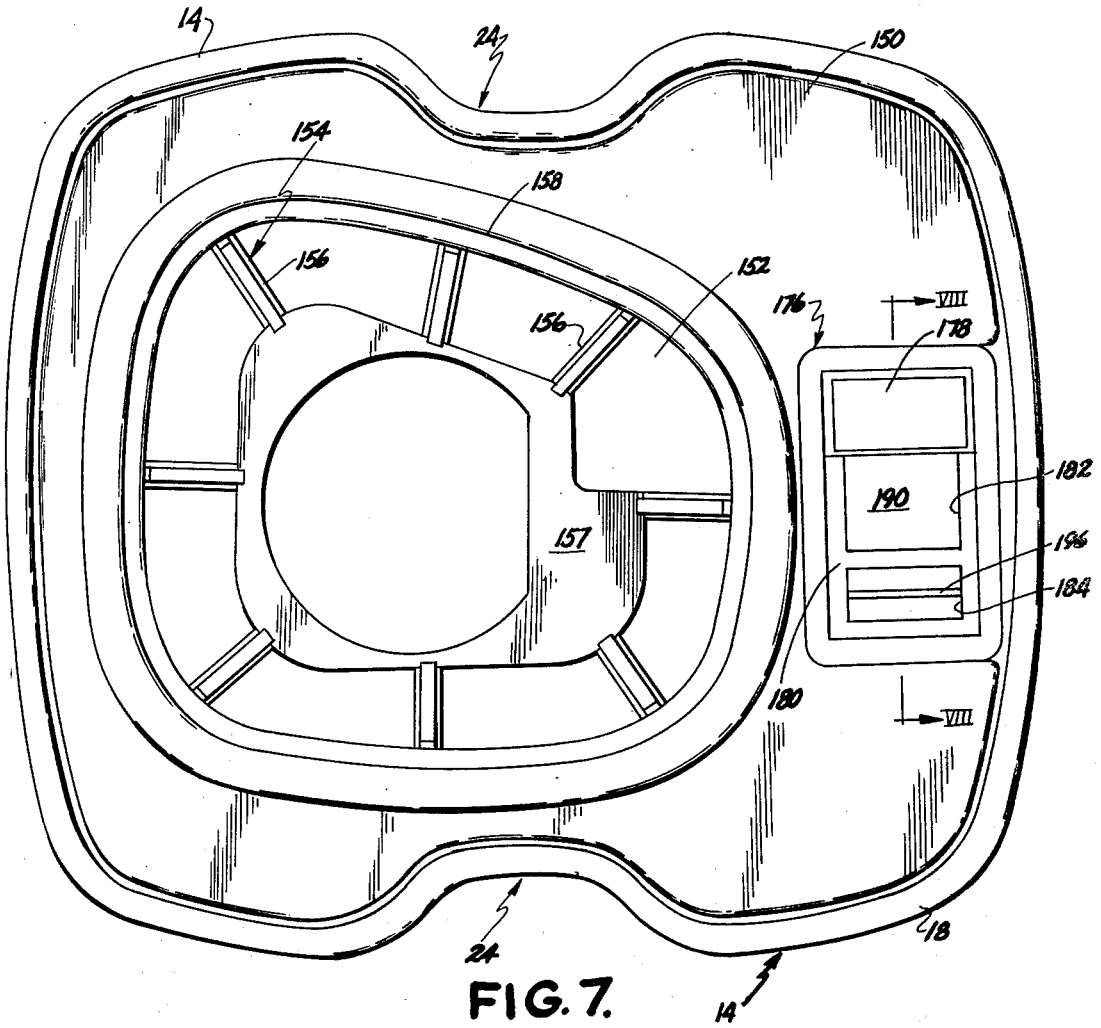
FIG. 7 is a top, plan view of the collection tank showing the filter bag frame, the tank adapter and the discharge tube.

As best seen in FIGS. 7 and 8, the tank 14 supports an adapter plate 150 having a central aperture 152 formed therein. Supported on the adapter plate 150 at the aperture 152 is a molded, plastic, filter bag frame 154. The bag frame 154 includes a plurality of ribbed sections 156, a base 157 and a peripheral, support flange or shoulder 158. As seen in FIG. 2, the frame 154 supports a filter system which is used when the apparatus is employed for dry collection. The filter system includes an inner bag 160 of Sateen and an outer bag 170 preferably formed of Dacron. The bags are held to the frame by ties 172 adjacent their upper ends.

Also, supported on the adapter plate 150 is a discharge tube 176. The discharge tube, as seen in FIGS. 2, 7 and 8, includes an elongated, tubular portion 178 which is dimensioned to extend to a point adjacent the bottom of the tank. One wall 180 of the tube is angled or sloped from vertical. This wall defines an aperture 182. Positioned adjacent the aperture 182 on an integral bracket housing 184 is a flapper valve 186. The flapper valve includes a flapper or door 188 having a gasket 190 secured to its innerface and a weight 192 secured to a leg portion 194. The flapper valve is pivotally secured at the bracket 184 by a pivot rod 196 and cotter pin 198. The discharge tube 176 is supported on the adapter plate 150 when the apparatus is employed for wet or liquid collection. When the valve element is in the first position and a vacuum is created within the tank, the flapper will pivot in a clockwise direction when viewed in FIG. 8, permitting the debris to enter the tank through the aperture 182. When it is desired to empty the tank, the valve element is shifted to the second position, the pressure within the tank will close the flapper valve and the liquid contained therein will be forced upwardly through the discharge tube 176 and out the aperture 40.

Figure 9:
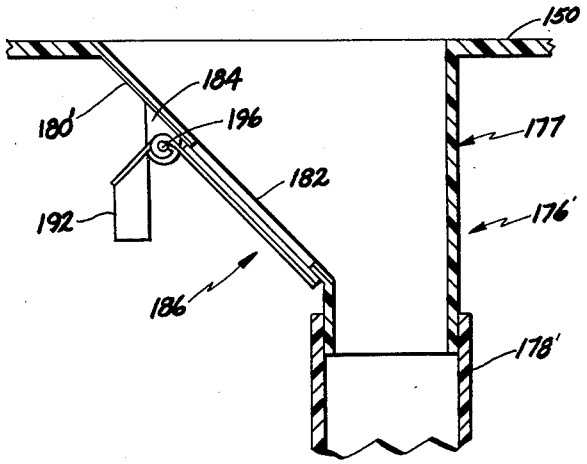
FIG. 9 is a fragmentary, cross-sectional view similar to FIG. 8 illustrating the preferred embodiment of the discharge tube.

The presently preferred embodiment of the discharge tube is illustrated in FIG. 9 and generally designated 176'. In this embodiment, an upper portion 177 of the tube 176' including angled wall 180' is molded integral with the adapter plate 150. An elongated tubular portion 178' is molded as a separate piece which slip fits onto the integrally molded portion 177. The same flapper valve 186 as in the FIG. 8 embodiment is mounted on wall 180'. This two piece construction simplifies use in the field since only portion 178' need be slipped onto the adapter plate. Also any sealing problems that might develop with the FIG. 8 embodiment are eliminated.

In order to prevent liquid from entering the fan or blower motor unit 50 and suction head, a float valve generally designated 200 and seen in FIGS. 2 and 3, is provided. The float valve 200 includes a generally cylindrical, open end housing structure 202 which is secured or formed integral with the plate 94 of the valve housing. Supported within the housing 202 is a screen mesh filter 204 and a polyurethane, open cell filter 206. These elements are held within the housing by a ribbed or spoked, generally open plate 208. The plate is held on the housing 202 by spring elements 210. A rod 212 extends downwardly from the center of the plate 208. Slidably supported on the rod 212 is an inverted, cup-shaped float valve element 213. The float valve element 213 includes a central hub 214 defining a bore for receipt of the rod 212. The cup includes a peripheral wall 216 and a base or top 218. It is presently preferred that the float element 213 be molded from polypropylene having a specific gravity of 0.890 to 0.905, a tensile strength of 2900 to 4500 psi and an elongation of 200% to 700% at break. Such an inverted cup float will float on foam and prevent ingestion of foam into the blower motor should the apparatus be employed for carpet shampooing.

Figure 5:
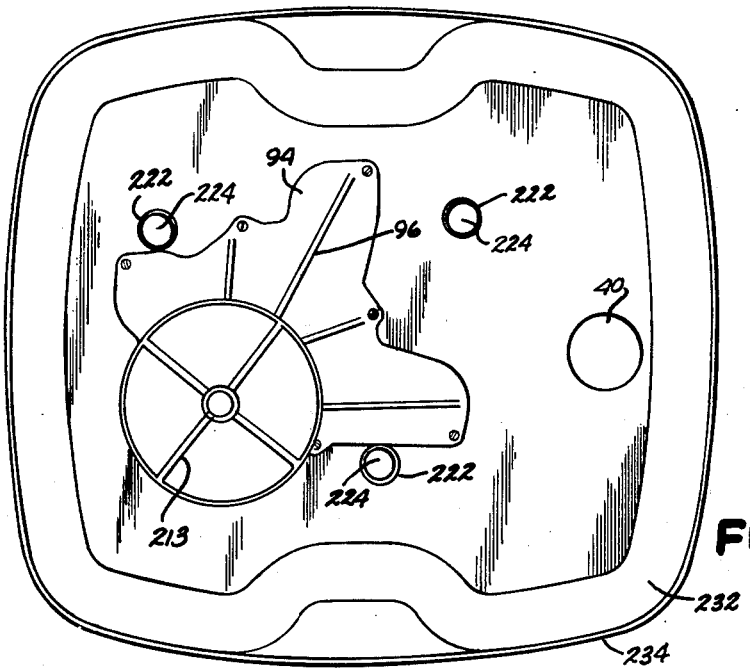
FIG. 5 is a bottom, plan view of the suction head.

As seen in FIGS. 2 and 5, the undersurface of the base 16 is provided with a plurality of spaced bosses 222. Inserted within the bosses 222 are support rods 224. The supports rods 224, as seen in FIG. 2, are dimensioned so that the suction head 12 may be removed from a tank and supported on these rods without damage to the float valve 200.

OPERATION

When the apparatus in accordance with the present invention is employed for dry debris pickup, the filter including the bags 168, 170 and the frame 154 is disposed within the aperture 152 of the plate 150. The discharge tube 176 is removed from the adapter plate 150 (FIG. 8), or the portion 178' is removed (FIG. 9). The suction head is then placed on top of the tank 114 and clamped thereto by the clamps 20. The valve element is in the position shown in FIG. 1 and is biased thereto by the spring 124 as previously described. The fan motor unit then creates a suction within the tank and dry debris will be drawn in through the hose coupling 48 and the aperture 40 and collected within the tank.

When the device is employed for wet pickup, the filter and frame assembly 154 are removed from the adapter plate 152 and the discharge tube is inserted therein or the portion 178' is slipped onto portion 177. Initially, the valve element 106 is in the position shown in FIG. 1 and liquid and other debris will be collected within the tank 14 by passing through the coupling 48, the aperture 40 and the aperture 182 defined by the discharge tube 176. When the liquid level within the tank raises the float 213 so that it contacts the plate 208, no liquid or air may be drawn up through the filter 206 or past the screen filter 204 and through the valve housing to the blower unit intake 56. The valve is then reversed by rotating the knob 120 and placing the valve element into the position shown in solid lines in FIG. 6. Pressurized air is then forced into the tank 40 closing the flapper valve 186 and forcing the liquid up the discharge tube 176 and out the hose coupling 48. In the preferred construction, the knob 132 on rod 118 is provided with a flipable latch 230 which may be pivoted relative thereto and received within a slot (not shown) in the top 72 of the cover 26. This holds the valve 106 in the pumpout or discharge, second position against the bias of the spring.

It is preferred as seen in FIGS. 5 and 6 that a gasket-like material 232 be provided around the periphery of the base 16 along a lower surface thereof. The gasket material 232 is positioned between an outer peripheral flange 234 (FIGS. 2 and 3) and an inner peripheral flange 236. Also, as best seen in FIGS. 1 and 3, it is presently preferred that a generally planar, L-shaped in cross section baffle plate 238 be secured to the upper surface of the base 16. The baffle plate 238 cooperates with raised walls 240 which extend generally radially outwardly from the atmospheric discharge-intake aperture 46 towards the peripheral wall 34. As a result, air discharged through aperture 46 will contact the walls 240 and the baffle plate 238 and will be directed outwardly around the periphery of the base and the cover through a slot 242 (FIG. 4) formed in the wall 34. The skirts 30, 32 formed with the cover also act as baffles which change the direction and rate of air flow discharging from the cover to thereby reduce the exhaust noise associated therewith.

It is presently preferred that the base 16 and the integral diverter valve housing 90 be molded from ABS structural foam having a tensile strength at 73° F. of 4000–6000 psi and a flexural yield strength at 73° F. of 7000–10,000 psi. Also, it is presently preferred that the filter 206 at the float housing 202 be open cell, polyurethane foam having 40–50 pores per inch and that the metal mesh screen 204 include 4 meshes per inch and be fabricated from a 0.035 diameter wire, galvanized steel wire industrial cloth defining a width opening of 0.215 inches and having 74% open area.

As should now be readily apparent, the unique wet/dry vacuum cleaner in accordance with the present invention represents a substantial improvement over apparatus heretofore available. The diverter valve including the housing 90 formed integral with the rigid, structural base 16 substantially reduces the manufacturing cost of the device and also eases the assembly thereof. The simple valve 106 including the resilient sealing elements 110 which cooperate with the stops 136, 138 and 140, 142 insures reliable operation in service. The parts are easily fabricated from plastic using simple molding techniques and are also easily assembled. The suction head may be adapted for use with a variety of different sized tanks, for example, and may be employed with tanks of 40, 50 or 65 liter capacity. The tanks need merely have the same cross-sectional shape at their top in order to receive the suction head.

In view of the foregoing description, various modifications will undoubtedly now become apparent to those of ordinary skill in the art which would not depart from the inventive concepts disclosed herein. Therefore, it is expressly intended that the above should only be considered as a description of the preferred embodiment. The true spirit and scope of the present invention may be determined by reference to the appended claims.

The embodiments of the invention in which an exclusive property or privilege is claimed are defined as follows.

1. A suction head for a wet/dry vacuum of the type including a collection tank, said suction head comprising:

a base adapted to rest on the collection tank, said base defining a tank inlet aperture, an intake aperture, an exhaust aperture and an atmospheric intake-discharge aperture;

a vacuum means secured to one side of said base for creating a vacuum at said intake aperture, said vacuum means including an intake connected to and communicating with said intake aperture and an exhaust; means connected to said exhaust and said exhaust aperture for communicating said exhaust with said exhaust aperture;

a valve housing defined in part by said base and being integral with said base opposite said vacuum means, said housing defining a tank opening communicating with said tank, said intake aperture, said exhaust aperture and said atmospheric intake-discharge aperture each opening into said valve housing through said base; and a planar valve element positioned generally vertically within said housing and rotatable between first and second positions within said housing about a vertical axis, said housing and said valve element being dimensioned and said valve element being positionable within said housing so that said intake aperture communicates with said valve housing tank opening and said exhaust aperture communicates with said atmospheric intake-discharge when said valve element is in said first position to draw air into said tank through said tank inlet aperture, and said intake aperture communicates with said atmospheric intake-discharge aperture and said exhaust aperture communicates with said tank opening when said valve element is in said second position to pressurize said tank, said valve element and said housing defining chambers connecting said apertures when said valve element is in said positions.

2. A suction head as defined by claim 1 further including valve actuator means operatively connected to said valve element for rotating said element between said first and said second positions.

3. A suction head as defined by claim 2 further including resilient means engaging said valve actuator means for biasing said valve element to one of said first and second positions.

4. A suction head as defined by claim 2 wherein said valve element comprises:

at least one generally planar, resilient member; and a pair of metal retainers secured to said resilient member one on each side thereof.

5. A suction head as defined by claim 4 wherein said valve housing includes a plurality of walls integral with said base and extending downwardly therefrom, each of said walls defining stops positioned to contact said resilient member and limit rotation of said member between said first and said second positions and for defining a seal with said resilient member to prevent cross communication between said chambers.

6. A suction head as defined by claim 5 further including a float valve carried by said valve housing in-line with said tank opening, said float valve being shiftable towards said tank opening to close off said tank opening.

7. A suction head as defined by claim 5 further including a plurality of support rods extending downwardly from said base on the side of said valve housing, said support rods dimensioned to support said suction head on a planar surface without said float valve contacting said surface.

8. A suction head as defined by claim 5 wherein said base defines an upwardly directed peripheral wall extending in spaced relationship with the periphery of said base and wherein said suction head further includes a cover including a peripheral flange resting on said base peripheral wall, said cover being secured to said base.

9. A suction head as defined by claim 8 wherein said valve actuator means comprises a rod secured at one end to said valve element and extending upwardly through said cover.

10. A suction head as defined by claim 9 further including a hose coupling carried by said base and extending from said tank inlet through said cover.

11. In a wet/dry vacuum apparatus including a suction head removably mounted on an open top collection tank, said suction head including a base, a vacuum means having an intake and an exhaust outlet mounted on said base, a cover secured to said base and a tank inlet communicating with said tank through said base, wherein the improvement comprises:

diverter means carried by said base for selectively creating either a vacuum in said tank so that debris and/or liquid may be drawn into said tank through said tank inlet or pressurizing said tank so that liquid and/or debris may be expelled from said tank, said diverter means comprising:

a valve housing defining a valve chamber, said housing being integral with said base and also defining an intake-discharge aperture opening through said housing into said tank;

a generally vertical planar valve element means positioned within said valve chamber and rotatable between a first, suction position and a second, pressurizing position, said base defining an intake aperture communicating said vacuum means intake with said chamber, said base defining an exhaust aperture opening into said valve chamber; means connected to said vacuum means exhaust outlet and said exhaust aperture for communicating said vacuum means exhaust outlet with said chamber and said base defining an atmospheric aperture opening into said chamber and communicating said chamber with the atmosphere, said valve element means permitting communication between said intake aperture and said intake discharge aperture and between said exhaust aperture and said atmospheric aperture when in said first position and said valve element means permitting communication between said intake aperture and said atmospheric aperture and between said exhaust aperture and said intake-discharge aperture when in said second position whereby said tank may be pressurized to discharge liquid collected therein, said valve element means including seal means sealingly engaging said valve housing for preventing cross communication between said apertures when said valve element means is in each of said positions.

12. In a wet/dry vacuum apparatus as defined by claim 11 further including float valve means carried by said base adjacent said intake-discharge aperture for closing said aperture to prevent intake of liquid to said vacuum means when said valve element means is in said first position.

13. In a wet/dry vacuum apparatus as defined by claim 12 further including a plurality of vertically extending stops integral with said housing and extending into said chamber, and stops positioned so that a pair thereof contacts opposite sides of said valve element means when said valve element means is in said first and second positions.

14. In a wet/dry vacuum apparatus as defined by claim 13 wherein said valve element means comprises:

an elongated, two-piece, resilient, rubber sealing member, said sealing member defining said seal means; and a pair of metal retainers sandwiching said sealing member to rigidify said sealing member, said sealing member contacting said stops when said valve element means is in said first and second positions.

15. In a wet/dry vacuum apparatus as defined by claim 14 further including an actuator rod nonrotatably secured to said valve element means and extending upwardly through said base and said cover for permitting manual rotation of said valve element means between said first and said second positions.

16. In a wet/dry vacuum apparatus as defined by claim 15 further including resilient means engaging said rod for biasing said valve element means to one of said first and second positions.

17. In a wet/dry vacuum apparatus as defined by claim 16 further including an adapter supported on said tank at the top thereof, said adapter defining a central aperture.

18. In a wet/dry vacuum apparatus as defined by claim 17 further including air filter means supported within said adapter aperture for filtering air drawn into said collection tank, said filter means including:

a molded, plastic frame suspended within said adapter aperture and sealingly engaging said adapter;

a first filter bag secured to said frame and within which said frame is received and a second bag secured to said frame and enclosing said first filter bag.

19. In a wet/dry vacuum apparatus as defined by claim 17 further including:

an elongated discharge tube supported on said adapter in-line with said tank inlet, said tube extending downwardly within said tank to a point spaced from the bottom of said tank, said tube including an aperture adjacent its top end; and a flapper valve pivotally mounted on said tube at said tube aperture, said flapper valve being open when said valve element is in said first position and closed when said valve element is in said second position so that liquid within said tank will be forced up said tube and discharged out said tank inlet.

20. In a wet/dry vacuum apparatus as defined by claim 19 wherein the portion of said tube having said aperture adjacent its top end is molded integral with said adapter and the portion of the tube extending downwardly within said tank is a separate member slip fit onto said apertured portion of said tube.

* * * * *